United States Patent [19]

Christianson

[11] Patent Number: 5,009,155

[45] Date of Patent: Apr. 23, 1991

[54] CAN CRUSHER FOR HOUSEHOLD USE

[76] Inventor: Konrad A. Christianson, 190 Cutler Dr., Durango, Colo. 81301

[21] Appl. No.: 331,642

[22] Filed: Mar. 30, 1989

[51] Int. Cl.[5] ..... B30B 7/00; B30B 1/02

[52] U.S. Cl. ..... 100/233; 100/293; 100/902

[58] Field of Search ..... 100/902, 280, 281, 283, 100/293, 233, 234

[56] References Cited

U.S. PATENT DOCUMENTS

| | | | |
|---|---|---|---|
| D. 272,539 | 2/1984 | Salatka | 100/902 X |
| D. 282,076 | 1/1986 | Taylor | 100/902 X |
| 310,336 | 1/1885 | Unger . | |
| 492,259 | 2/1893 | Barrett . | |
| 684,784 | 10/1901 | De Bolster . | |
| 968,848 | 8/1910 | Himebaugh . | |
| 1,350,477 | 8/1920 | Small . | |
| 1,715,680 | 6/1929 | Shepherd et al. . | |
| 2,238,571 | 4/1941 | Scott . | |
| 2,563,379 | 8/1951 | Smith . | |
| 3,009,414 | 11/1961 | Griemert . | |
| 3,079,856 | 3/1963 | Swartz . | |
| 3,204,550 | 9/1965 | Swiderski et al. . | |
| 3,208,372 | 9/1964 | Taylor . | |
| 3,253,537 | 5/1966 | Porter et al. . | |
| 3,411,722 | 11/1968 | Webber . | |
| 3,461,821 | 8/1969 | Gallus . | |
| 3,580,167 | 5/1971 | Simshauser . | |
| 3,777,659 | 12/1973 | McCarten . | |
| 3,780,647 | 12/1973 | Reimers . | |
| 3,889,587 | 6/1975 | Wharton . | |
| 3,934,498 | 1/1976 | Hochanadel . | |
| 4,062,283 | 12/1977 | Kaminski . | |
| 4,133,261 | 1/1979 | Belfils . | |
| 4,143,595 | 3/1979 | Carlson | 100/280 |
| 4,168,661 | 9/1979 | Wigdahl . | |
| 4,197,796 | 4/1980 | Salatka | 100/293 |
| 4,213,387 | 7/1980 | McCaney et al. | 100/293 X |
| 4,228,734 | 10/1980 | Parrish | 100/902 X |
| 4,326,457 | 4/1982 | Sather . | |
| 4,345,518 | 8/1982 | Cash et al. . | |
| 4,345,520 | 8/1982 | Goldsmith et al. | 100/293 |
| 4,459,908 | 7/1984 | Sierk . | |
| 4,532,861 | 8/1985 | Gisselberg, III | 100/293 X |

FOREIGN PATENT DOCUMENTS

| | | |
|---|---|---|
| 1156139 | 6/1969 | United Kingdom . |
| 2011302 | 6/1978 | United Kingdom . |

OTHER PUBLICATIONS

Catalog Excerpt–The Alsto Company, Gatesburg, IL; with related photographs; Fall 1988, p. 43.

*Primary Examiner*—Harvey C. Hornsby
*Assistant Examiner*—Stephen F. Gerrity
*Attorney, Agent, or Firm*—Kenton L. Freudenberg; Maxwell C. Freudenberg

[57] ABSTRACT

A device, suitable for household use, for the purpose of crushing ordinary aluminum beverage cans between a movable and a stationary compression plate. The movable compression plate moves generally parallel to a can's axis, initially engaging the can at an edge thereof to apply crushing force along one side of the can and tending to overcome the can's structural integrity. The movable plate rotates slightly as it moves through a compression stroke. At the end of the stroke the two compression plates are parallel to one another and spaced apart sufficiently to (1) make the crushed can as compact as possible and (2) to minimize the possibility of injury which might result from, for example, closing the plates on human fingers when a can is not in place. The operating portions of the device are mounted to a back plate which is sufficiently long to provide leverage to allow the device to be operated without being mounted to a surface such as a wall.

7 Claims, 4 Drawing Sheets

CAN CRUSHER FOR HOUSEHOLD USE

BACKGROUND OF THE INVENTION

Aluminum cans have become one of the most common methods of distributing beverages such as soft drinks and beer. The recyclability of such cans and the value of aluminum have made the saving of empty cans desirable. However in their intact form the volume required for storage of a quantity of empty cans can be very large. When crushed or flattened the cans are more easily managed and take up far less volume. Although aluminum cans can be crushed rather easily, the devices which have been designed to accomplish this task are still capable of exerting compressive forces strong enough to cause injury to a human hand or fingers. The present invention, intended for household use, operates in such a manner that it accomplishes the crushing of a can with a minimum application of force to the device and utilizes a compressive mechanism which closes sufficiently to crush a can to an efficient size but, when no can is in place to be crushed, will not close completely on, for instance, a human finger, particularly that of a child. The device is also completely portable and is capable of being used with its crushing axis in either its upright or horizontal position without being anchored to a wall, counter or other surface.

SUMMARY OF THE INVENTION

Numerous prior art patents show devices intended to accomplish the function of crushing aluminum cans. The closed cylindrical structure of a typical aluminum can is such that, in its intact state, a can is capable of resisting a substantial compressive load applied to one end and directed along the cylindrical axis. This load can be on the order of 200 pounds. However if the load is applied off center or if the can is deformed slightly, the initial force required to compress a can be quite small. In order to minimize the force required to begin compressing a can, prior art devices have utilized means of reducing the structural integrity of the can and facilitate its being crushed. U.S. Pat. No. 4,168,661 to Belfils shows a device which uses a tilted position of a can to apply a compressive force along one edge of a can to cause a "crippling" effect so that the crushing of the can is easily initiated. U.S. Pat. No. 3,934,498 to Hochanadel describes a device in which a can is twisted to initially weaken it. U.S. Pat. No. 3,889,587 to Wharton shows a device in which a can is initially weakened by using blades to slit the sides of the can. U.S. Pat. No. 4,345,518 to Cash et al shows a device in which piercing and denting of the can are both used to weaken it.

Aluminum can normally used for packaging beverages are of two common sizes, each size being cylindrically shaped. The first, and most commonly used size, which shall be referred to herein as a 'standard' size can, which has a standard capacity of 12 fluid ounces, is nearly uniformly 4.8 inches high and 2.6 inches in diameter. The second, with a standard capacity of 16 fluid ounces, has a standard height of approximately 6.25 inches. When crushed in a uniform manner along their cylindrical axis these cans can be easily compressed to a height of approximately 0.75 inches with a diameter slightly larger than their uncrushed size. Once a can has been crushed to approximately this size, the force required to achieve any further crushing is substantially increased. Therefore, 0.75 inches is the approximate height of a fully crushed can. By providing a stop for the manually operated handle, the present invention prevents the application of any force beyond that required to achieve this nearly optimum crushing of the can and provides an additional margin of safety in that neither the device nor the can being crushed can be subjected to unreasonable stresses.

The operating mechanism of the present invention is also such that its mechanical advantage increases as a movable compressing plate moves through its range of motion. This plate is the portion of the device in contact with the can and directly accomplishes the crushing of the can.

Prior art devices are also typically designed to be constructed out of metal and do not lend themselves to economical construction out of wood as does the present device.

It is an object of the present invention to provide a can crushing device which initially applies a compressive force off center to facilitate the crushing of a can.

It is another object of the present invention to provide a can crushing device in which the parts cannot be overloaded by attempting to compress a can beyond its minimum practical compressed size.

It is a further object of the present invention to provide a can crushing device in which the unloaded compressor means cannot be closed completely on a human finger.

It is another object of the present invention to provide a can crusher in which the compressor means begins its travel by applying a force to an edge of a can but which completes its compressing action so that the opposite ends of the can are parallel to each other so that the crushed can is as compact as possible with the use of reasonable manual force.

It is another object of the present invention to provide a can crushing device which need not be anchored to a horizontal or vertical surface to be used.

It is another object of the invention to provide a manually operable can crusher in which the crushing of a can is accomplished with single stroke of the operating mechanism and in which the manually operating force is at all times directed generally toward the supporting base of the device.

DESCRIPTION OF THE PREFERRED EMBODIMENT

The preferred embodiment of the present invention is intended to be constructed out of wood with the attendant benefits of being both aesthetically pleasing and economical to manufacture. As described herein the present invention is particularly suitable for assembly from small pieces cut from utility grade woods which are more economical than high grade woods but which allow cutting of small pieces of very high grade. Each separate element of the device as described can be cut from 1 inch wood stock, which has a nominal thickness of 0.75 inches. Maple wood is recognized for its strength and general toughness and is suitable for construction of the present device. Alder wood has also been found to be suitable and provides the additional advantage of allowing a device of lighter weight to be constructed. Any other suitable wood could also be used. As described herein, joints that are described as being glued can be assembled using any suitable wood glue. Ordinary wood screws or self-threading "drywall" screws such as #8 "deep thread phillips flat head" with their heads countersunk to be flush with the surface of the wood into which they are driven are suitable fasteners to be used either alone or in conjunction with gluing of a joint. When used in conjunction with gluing, these fasteners provide (1) additional structural support, (2) a means of securing the pieces together while the glue is setting, or (3) both of the foregoing.

Figure 1:
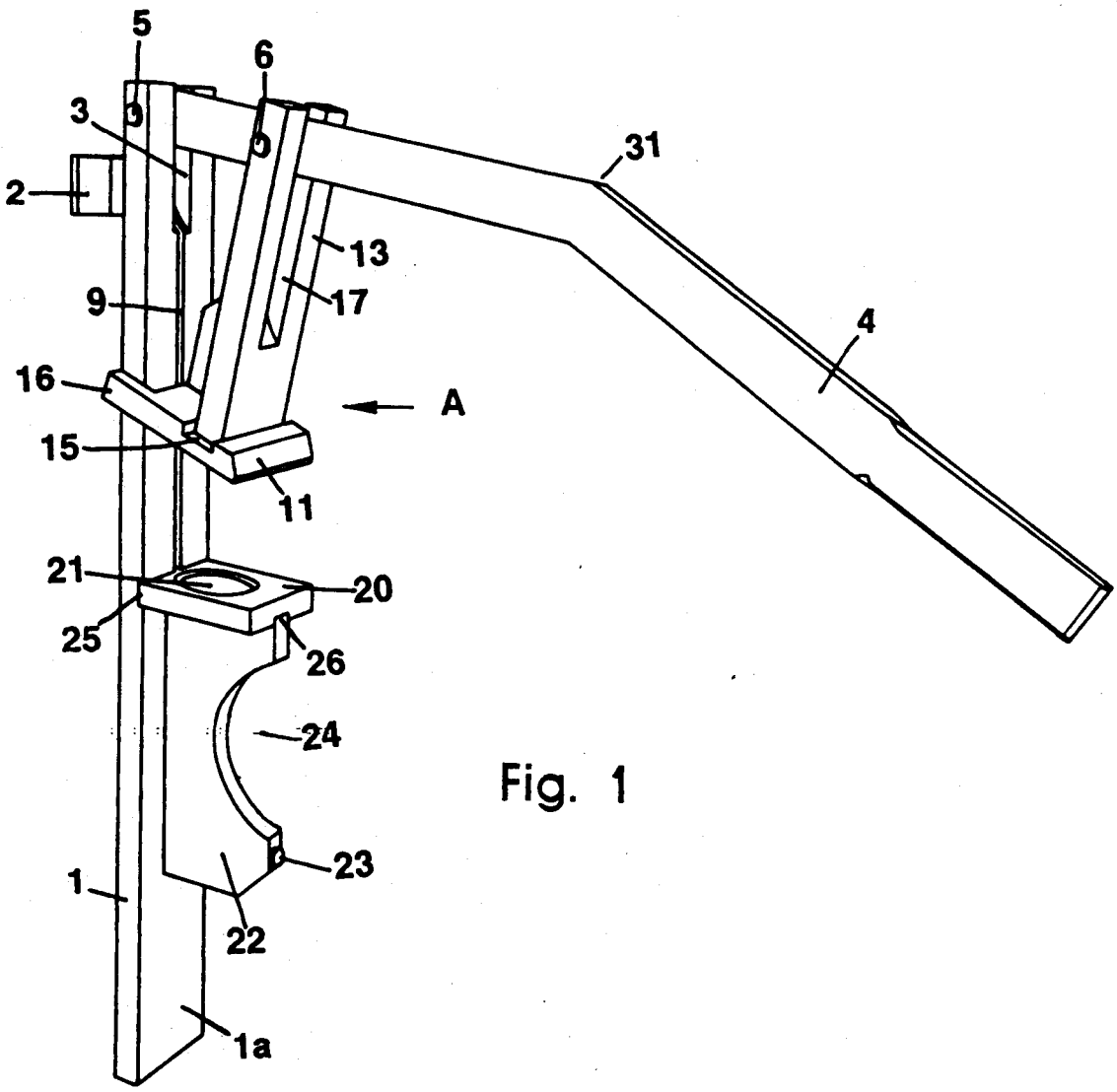
FIG. 1 is a perspective view of the present invention showing the front face of the back plate.
Figure 2:
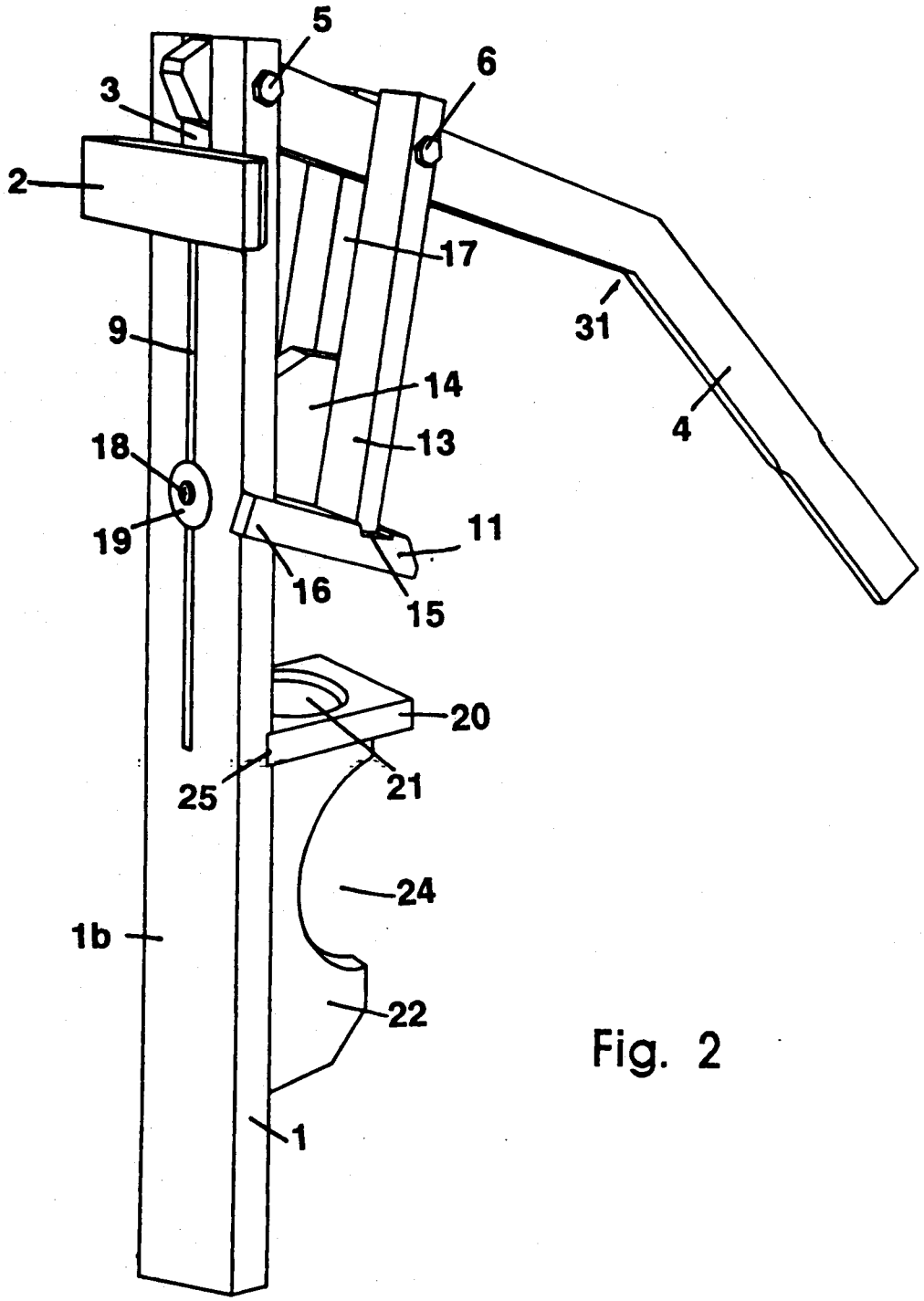
FIG. 2 is a perspective view of the present invention showing the rear face of the back plate.

The device of the preferred embodiment shown in FIG. 1 comprises an elongated flat back plate member 1 approximately 3 inches wide and 28 inches long which, during use of the device, can be placed against any vertical or horizontal surface. As shown and described herein a vertical orientation is assumed, such as would be the case of a device mounted on a wall. However, it is to be understood that the device may be operated in virtually any orientation and need not be fixed to a surface. The back plate is provided with a slot 3 approximately 182 inches wide at its upper end to receive the end of a manually operable movable handle or lever arm 4 which is pivotably attached within slot 3. Lever arm 4 has near the end closest to the first pivot point 5 an additional and secondary pivot point 6 at which is pivotably attached an end of a drive member 13 of a movable ram assembly A. The upper portion of the bifurcated drive member 13 is provided with a ¾ inch slot 9 so that the drive member straddles the lever arm 4. The pivot means 5 and 6 comprise Grade 5 capscrews or bolts of 5/16 inch diameter and 3½ inches long secured with locking nuts having a nylon insert so as to prevent any undesired tightening or loosening of the nut during use. The bolts pas through holes in the respective portions of the back plate 1, lever arm 4 and drive member 13, which are pivotably connected. The axis of the bolt for the pivot point 5 extends transversely of the back plate and lies at the center plane of the back plate which is parallel to the front face of the back plate. The portion of each bolt which passes through the lever arm is unthreaded to provide a relatively smooth bearing surface. The wood of the present device can swell and contract with varying atmospheric humidity and can affect the fit of the pivoted connection and the smoothness of its operation. By using self-locking nuts the tightness of the pivot bolts adjustable but lockable so that the pivot points can be kept operating smoothly without any unnecessary binding or excessive looseness.

The lever arm 4 and back plate 1 are nearly equal in length so that the device can be operated in either a horizontal or vertical position without being permanently mounted to a surface and can, for instance, be operated by an individual who is sitting with the device on his lap.

The ram assembly A comprises a movable compressor plate 11, the elongated ram driving member 13 and a gusset 14. The top surface of a can is engaged by the essentially planar lower face of the movable compressor plate 11. The ram driving member 13 is the same width as the back plate 1 and is secured to the movable ram plate 11 using a glued dado joint in which the solid end of the drive member 13 fits precisely in a transverse groove 15 in the plate 11. This joint may be further reinforced with suitable fasteners (not shown) driven from the lower face of the plate into the lower end of the driving member. The plane of the driving member is oriented at a fixed angle of approximately 80° to the plane of the movable compressor plate 11. The plane of gusset 14 is oriented at right angles to the planes of both the driving member 13 and the movable plate 11, because of the relatively high compressive loads on the ram assembly A which may be encountered in the operation of the device, gusset 14 provides reinforcement to the joint between the drive member 13 and the compressor plate 11. Gusset 14 is cut to fit precisely in the acute angle between the drive member 13 and the compressor plate 11. Gusset 14 is glued into a dado groove (not shown) in the compressor ram plate extending rearwardly from the groove 15 for the drive member and is glued flush to the rear face of the drive member 13. The compressor plate 11 itself is approximately 1 inch wider than the back plate 1 so that each of two wing portions 16 of the compressor plate 11 can extend past the front surface of the back plate to adjoin a corresponding one of the two parallel edges of the back plate to slide therealong as a guide means. Plate 11 is slidably and pivotably attached to the back plate by means of a common #12 round head wood screw 18 being smooth and unthreaded over the portion of its shank which passes through a longitudinal guide slot 9 in the back plate. The slot is just wide enough to allow the screw to slide freely therein. Screw 18 passes into the rear edge of compressor plate 11 at a slight upward angle passing through the plate and extending into the gusset 14. To facilitate the sliding action of the screw against the rear face **1*b* of the back plate, a large smooth fender washer 19 is positioned on the screw between the screw head and the rear face 1*b* of the back plate 1**.

Figure 3:
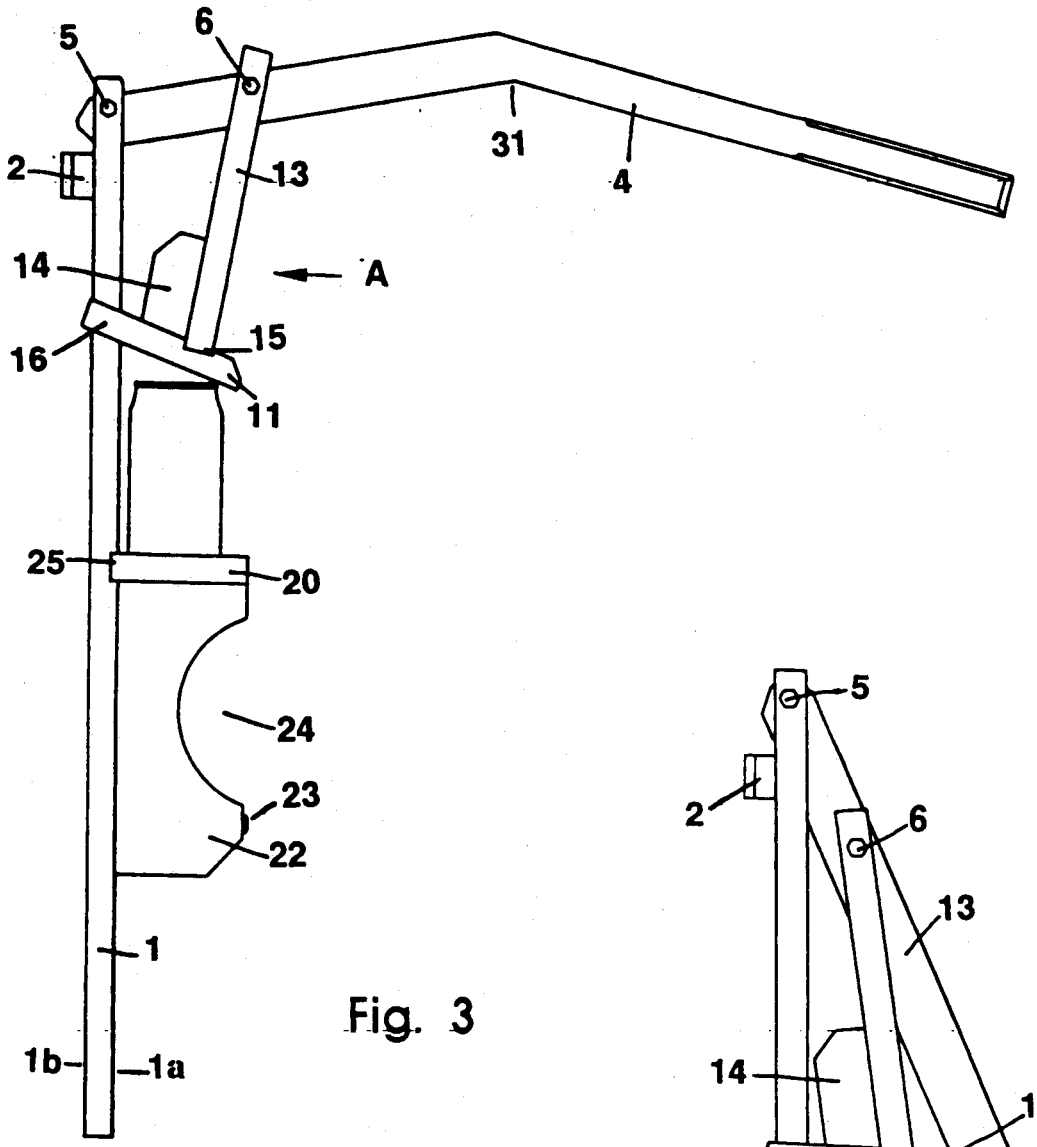
FIG. 3 is a side view showing the present invention as the movable compressor ram plate engages the upper edge of a typically sized aluminum can.
Figure 4:
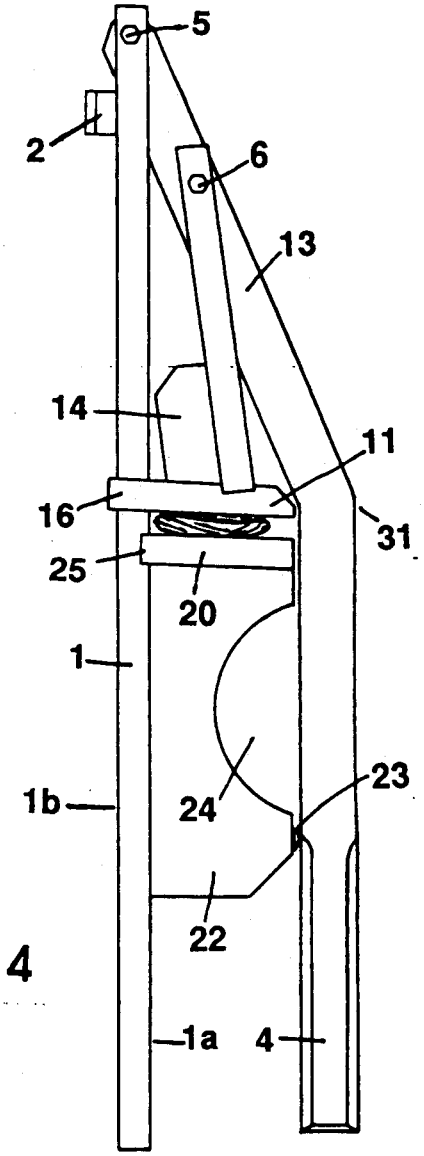
FIG. 4 is a side view showing the present invention in its fully closed position in which the plates of the compressor do not meet.

As seen in FIGS. 3 and 4 the drive member 13 pivots or rotates relative to its lower end approximately equal arcuate amounts on opposite sides of the vertical. In the position shown in FIG. 4, the drive member 13 is at an angle of 10 degrees to the left of the vertical, i.e. 80 degrees with respect to the horizontal plate 11. In FIG. 3 the drive member at the point of initial contact with a standard size can is inclined a similar distance to the right of the vertical. Thus the face of the plate 11 is substantially inclined to the top of the can and to the plane of the base plate 20 in FIG. 3 by an angle equal to the angle through which the drive member rotates as just described in moving between the positions of FIGS. 3 and 4.

A support block 2 is suitably secured to the upper end of the back plate 1 to provide spacing between the back plate 1 and a surface against which it is used so that interference between the end of lever arm 4 of the sliding retaining screw 18 and the surface can be avoided. Support block 2 is wider than the back plate and provides additional transverse stability of the device when it is used against or mounted on a surface.

A stationary compressor base plate 20 is fixedly mounted perpendicular to the back plate 1. The compressor base plate is secured by fitting tightly into a dado recess 25 cut into the back plate 1. This joint is preferably glued and may be secured with additional suitable fasteners driven parallel to the compressor base plate 20 from the rear face 1*b* of the back plate 1 into the rear edge of compressor base plate. The compressor base plate 20 has a shallow cylindrical recess 21 approximately 0.2 inches deep and of a diameter slightly larger than that of a typical can to help hold a can in position as it is being crushed.

The compressor base plate 20 is further supported by a brace 22 located below and adjacent to the compressor base plate on the front face 1*a* of the back plate 1. Brace 22 is oriented perpendicular to both the compressor base plate 20 and the back plate 1. The brace 11 fits tightly into a dado groove (not shown) in the front face 1*a* of the back plate 1 and is glued into place and may be further anchored from the rear face 1*b* of the of the back plate 1 with suitable fasteners. Brace 22 is similarly secured within a dado groove 26 on the lower face of stationary compressor plate 22 as shown in FIG. 1. Located on the outer edge of brace 22 near the lower edge is a stop 23 which prevents the lever arm from moving past a predetermined point corresponding to the position of the ram assembly at which a can has been crushed to its minimum practical size. Stop 23 comprises a slightly raised portion of brace 22 positioned to engage handle 4 as close as possible to the point on the handle where manual force is applied to operate the device.

As previously described a can is fully crushed when it has been reduced to a height of approximately 0.75 inch. Taking into account the 0.2 inch depth of the cylindrical cutout in the fixed compressor base plate, the movable and fixed compressor plates need be no closer than about 0.5 inches between their facing surfaces at the end of a stroke. This half-inch gap when the device is fully closed and not can is in place, is sufficient to provide a substantial factor of safety since the bones of many adult fingers and most children's fingers are small enough to fit within such a gap. This effectively prevents the device from closing completely on such a finger and body and subjecting it to the tremendous crushing forces described in detail below, which the present invention is readily capable of generating.

Brace 22 is further provided with an arcuate cutout 24 which provides a means of grasping the device, particularly when it is not secured to a surface. This cutout 24 is sufficiently large so that the device can be safely grasped with one hand even as the lever arm is moved with the other hand to its fully closed position against the stop 23 on the brace 22.

Figure 5:
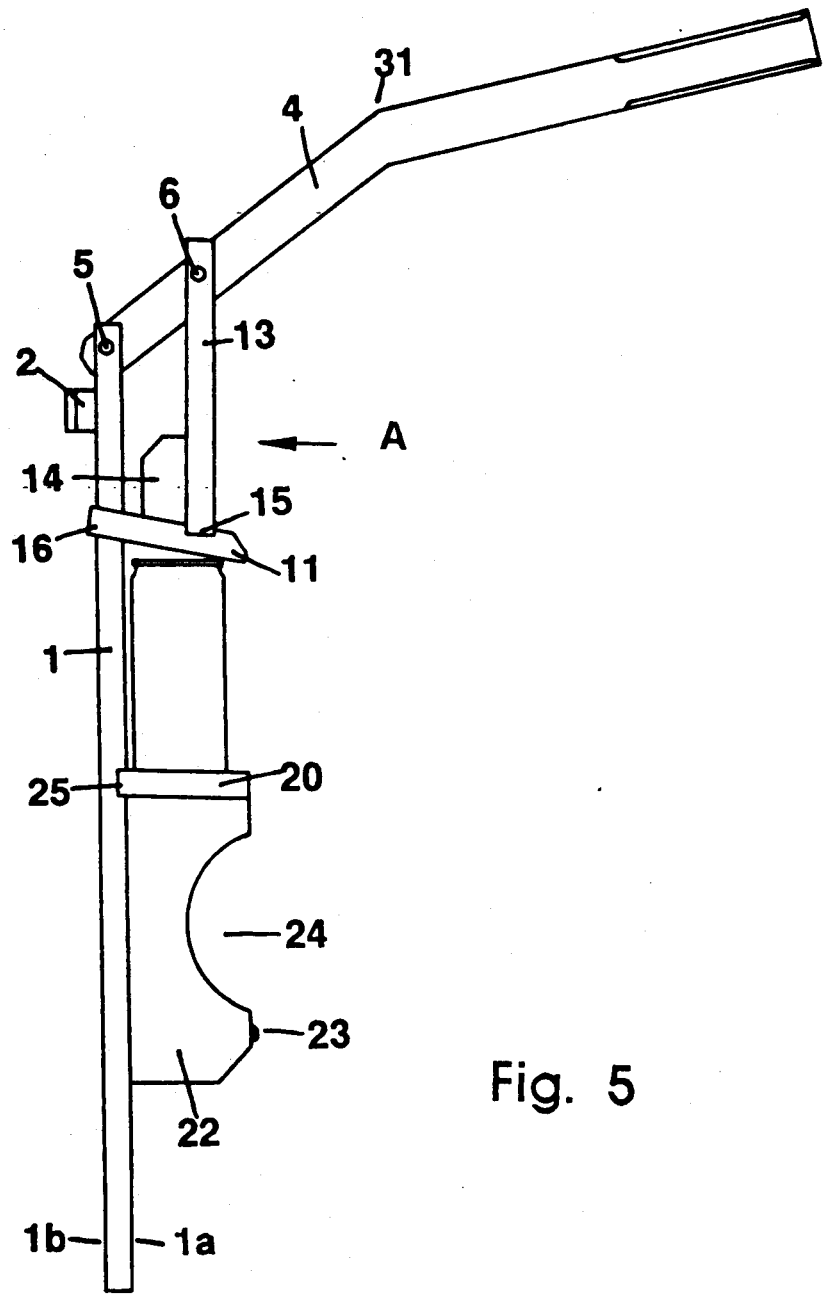
FIG. 5 is a side view showing the device of the preferred embodiment as its movable compressor engages the upper edge of a large size aluminum can.

Cans are fully crushed between the base plate 20 and ram assembly A as the ram is moved toward the base plate 20 by means of manual actuation of the lever arm 4 through a single stroke. In operation, the lower face of movable plate 11 of the ram assembly A contacts one of the can's circular ends at a slight angle so as to initially apply toe crushing force along one longitudinal side of the can causing it to buckle, thus destroying the can's structural integrity and facilitating its complete flattening along its axis. The ram assembly A moves in a generally linear path along the front face of the back plate 1, parallel to and guided by the back plate 1. As the handle 4 is moved through an arc, pivot point 6 is also moved through an arc causing the upper end of the ram assembly which is attached thereto to move from a position at some horizontal distance from the back plate 1 to a position horizontally closer to the back plate when the device is in the closed position. Because of this slight horizontal component to the movement of the upper end of the ram assembly, the lower face of the movable plate 11 rotates slightly relative to the back plate as the device is moved through the compressing stroke. As shown in FIGS. 3 and 5, the face of the plate 11 first contacts an edge of an end of an intact can away from the back plate 1. By initially engaging the upper edge of a can at a point away from the back plate, the movable plate 11 tends to hold a can in position against the back plate 1 as the can is crushed. At the end of its stroke the lower face of the movable plate 11 is parallel to the compressor base plate 20 as shown in FIG. 4 so that the compressed can is kept in a generally cylindrical shape for maximum compactness.

As shown in FIG. 3, when a typical 12 ounce capacity can is to be crushed, the upper end of lever arm 4 is nearly perpendicular to the axis of the can so that any movement of the lever arm 4 causes arcuate movement of the second pivot point 6 which is essentially parallel to and corresponds directly to the linear movement of the ram assembly A. As shown by FIGS. 3 and 4, the full range of the arcuate movement of the lever arm after initial contact of the drive plate 11 with a standard size can is less than 90 degrees, thus insuring that the operating force applied to the lever arm is always directed generally toward or parallel to the back plate, and is never directed away from the back plate. By having the operating force always directed in this manner, the back plate is capable of providing sufficient stability for operation of the device, even though the device may not be secured to an external surface. The mechanical advantage obtained is essentially that of the lever arm, which is the ratio of two distances from the primary pivot point 5. These two respective distances are measured to (1) the approximate point on the lever arm where the manual force is applied and (2) the secondary pivot point 6 from which an operating force is directed to the ram assembly. The distance from the pivot point of the lever arm on the back plate is approximately 26 inches from the point on the handle which would be gripped manually to operate the device. The second pivot point 6, from which the movable compressor ram plate is driven, is approximately 4 inches from the primary pivot point 5 of the lever arm 4. Thus, the lever arm alone provides the primary mechanical advantage with a factor of approximately 26/4 or 6.5 at the beginning of its stroke.

As the lever arm 4 is moved through its range of motion to the position where the movable plate 11 reaches the end of its travel and its closed position, the arcuate movement of the second pivot point 6 becomes increasingly less parallel to the movement of the ram. At the end of the stroke a relatively large arcuate movement of the lever arm and second pivot point corresponds to a relatively small linear movement of the ram so that an additional mechanical advantage is created. In the device as describe herein final movement of the second pivot point 6 takes place at an angle of approximately 66° to the movement of the ram, creating a mechanical advantage of approximately 1/cosine(66°) or 2.46. At the end of the stroke a device as described herein has a total mechanical advantage resulting from the leverage of the handle multiplied by that described above. This total is approximately $6.5 \times 2.46$, or a factor of nearly 16. Thus, for a force of 10 pounds applied to the handle of the device compressive forces of nearly 65 and 160 pounds are applied to a can at the beginning and end of a stroke respectively. The mechanical advantage of the present invention readily permits the handle to be manually moved from the position shown in FIG. 3 to the fully crushed position of FIG. 4 because the pivot point 5 always remains during the crushing movement substantially spaced from a line connecting the ends of the lever and the back plate which are remote from the pivot point 5. During essentially all of the crushing operation these latter remote ends of the lever and the back plate are on the same side of a transverse plane perpendicular to the back plate and containing the axis of the pivot 5.

The lever arm 4 as seen in FIG. 4 has two straight arm portions joined about midway along the length of the lever arm at a bend 31 which lies directly opposite the compressor drive plate 11 and adjacent to the compressor base plate 20 so that in its closed position its manually grippable portion lies adjacent to and parallel to the outer edge of brace 22 and generally parallel to the back plate 1 allowing the device to be relatively compact and allowing stop 23 to be positioned near the handle end of lever arm 4 at which manual force is applied. Handle 4 is constructed of two straight wooden pieces each with the grain of the wood running generally longitudinally. The pieces are joined at the bend 31 with a spline joint in which a straight grained wood portion is inserted into a slots comprising approximately one-third of the thickness of each of the wood handle portions, thereby providing a continuous extend of longitudinal grain wood across the joint between the handle portions. The handle portions are butted and glued to each other, and each is glued to the spline portion.

Other variations within the scope of this invention will be apparent from the described embodiment and it is intended that the present descriptions be illustrative of the inventive features encompassed by the appended claims.

What is claimed is:

1. A device for crushing common cylindrical beverage cans comprising:

an elongated flat back plate having a front face and a center plane parallel to its front face, lever means having one end pivotably attached to said back plate at said center plane near one end of the back plate and having a handle at the other end of the lever means, a stationary compressor base plate fixedly mounted on said back plate near the longitudinal center thereof and perpendicular to said back plate, said compressor base plate being essentially flat and having two opposite sides, one of said sides having a surface for engaging an end of a common cylindrical can, a movable ram assembly comprising an elongated drive member with a flat compressor drive plate rigidly connected to one end of the drive member, wherein a can is crushed between said base plate and the drive plate of said ram assembly, the other end of the elongated drive member of said ram assembly being pivotably fastened to said handle at a single point therealong, said drive plate being slidably fastened to said back plate, said back plate and said compressor drive plate further comprising longitudinal guide means to direct the sliding movement of said ram assembly with one portion of said drive plate sliding along a face of said back plate in a linear path and said ram assembly pivotably moving relative to said back plate, the drive plate of said ram assembly having a substantially planar face to contact the other end of a can positioned against the stationary compressor base plate, said ram assembly being movable, by manual operation of said lever means using a single stroke, between an open position for receiving a can to be crushed and a closed position in which the can is fully crushed, the face of said ram assembly being parallel to and spaced from said stationary plate with the can crushed therebetween when in the closed position, said ram assembly face being substantially inclined to said base plate when the ram assembly is moved into initial contact with the end of a can to cause initial collapse of the can at one side of the can, said lever means comprising two straight lever arm portions angularly joined to each other at a bend which lies about midway along the length of the lever means, said bend being opposite the compressor drive plate in the closed position of the ram assembly, the handle of said lever means lying opposite the other end of the elongated back plate in the closed position of the ram assembly, said compressor base plate being further supported relative to said back plate by a brace portion at said side of the compressor base plate opposite its can-engaging surface, said brace portion being provided with a stop located substantially beyond the compressor base plate and engageable with said lever means at a point spaced from aid bend and near said handle to prevent movement of the handle beyond a position corresponding to a fully crushed can.

2. A device according to claim 1 wherein said movable ram assembly during its crushing movement first engages an outer edge of an end of a can away from said back plate to direct an initial crushing force axially at one edge of a can.

3. A device according to claim 1 wherein a substantial portion of the device including the straight lever arm portions of the lever means is constructed from wood.

4. A device according to claim 1 wherein said handle moves through an arc of less than approximately 90 degrees between said open and closed positions in crushing a standard size can.

5. A device according to claim 1 wherein, throughout the movement of said lever means between open and closed positions, the point of pivotal attachment of the first end of the lever means to the first end of the back support means remains substantially spaced from a line connecting the other ends of the lever means and the back support means so that the device can be easily operated manually without the back support means being attached to any other structure, said other ends of the lever means and the back support means being located during all of the crushing operation on the same side of a transverse plane which is perpendicular to the back plate and includes the pivot axis of the lever means at the back plate.

6. A device according to claim 1 wherein the handle of the lever means is substantially parallel to said back plate when the device is in the closed position.

7. A device according to claim 1 wherein said brace portion h as a portion between said stop and said compressor base plate which can be grasped by the user while the handle is moved to the closed position.

* * * * *